US011939976B2

(12) United States Patent
Takama et al.

(10) Patent No.: US 11,939,976 B2
(45) Date of Patent: Mar. 26, 2024

(54) SCROLL COMPRESSOR

(71) Applicant: Valeo Japan Co., Ltd., Kumagaya (JP)

(72) Inventors: Kazuki Takama, Kumagaya (JP); Hironobu Deguchi, Kumagaya (JP); Shinsuke Miyamae, Kumagaya (JP); Toshiki Maruyama, Kumagaya (JP); Imed Guitari, Le Mesnil Saint Denis (FR); Shunichiro Motohashi, Kumagaya (JP)

(73) Assignee: Valeo Japan Co., Ltd., Kumagaya (JP)

( * ) Notice: Subject to any disclaimer, the term of this patent is extended or adjusted under 35 U.S.C. 154(b) by 0 days.

(21) Appl. No.: 17/808,738

(22) Filed: Jun. 24, 2022

(65) Prior Publication Data

US 2022/0412353 A1 Dec. 29, 2022

(30) Foreign Application Priority Data

Jun. 24, 2021 (JP) ..... 2021-104664
May 19, 2022 (JP) ..... 2022-082021

(51) Int. Cl.
*F04C 18/02* (2006.01)
*F04C 23/00* (2006.01)
*F04C 29/00* (2006.01)

(52) U.S. Cl.
CPC ..... *F04C 18/0215* (2013.01); *F04C 23/008* (2013.01); *F04C 2240/801* (2013.01)

(58) Field of Classification Search
CPC ..... F04C 18/0215; F04C 18/0246; F04C 2240/30; F04C 29/00
See application file for complete search history.

(56) References Cited

FOREIGN PATENT DOCUMENTS

| | | | | |
|---|---|---|---|---|
| CN | 107882732 A | * | 4/2018 | ..... F04C 18/0215 |
| EP | 3081742 A1 | * | 10/2016 | ..... F01C 21/02 |
| JP | H01-105780 U | | 7/1989 | |
| JP | 2009-293523 A | | 12/2009 | |
| JP | 2010-101189 A | | 5/2010 | |
| JP | 2011-027100 A | | 2/2011 | |
| JP | 2016-176458 A | | 10/2016 | |
| JP | 2019-015214 A | | 1/2019 | |

OTHER PUBLICATIONS

English translation of EP-3-81742 by PE2E, Oct. 20, 2022.*
English translatoin of CN 107882732 by PE2E Oct. 20, 2022.*
Extended European Search Report in corresponding European Application No. 22178107.3, dated Nov. 16, 2022 (8 pages).

* cited by examiner

*Primary Examiner* — Deming Wan

(57) ABSTRACT

A scroll compressor has a drive shaft which drives a scroll compression mechanism housed in a housing and a drive shaft support member which supports the drive shaft. The drive shaft support member includes a plate portion having a predetermined thickness in an axial direction of the drive shaft. One side end surface of the plate portion has thereon a sliding support surface which supports the sliding movement of an orbiting scroll. Another side end surface of the plate portion has formed thereon a protruding portion which, protruding toward the other side in the axial direction, is fitted onto an inner peripheral surface of the housing. The protruding portion is interference fitted onto the inner peripheral surface of the housing, and thereby the drive shaft support member is fixed to the housing.

2 Claims, 5 Drawing Sheets

SCROLL COMPRESSOR

BACKGROUND OF THE INVENTION

1. Field of the Invention

The present invention relates to a technology for improvement of a scroll compressor.

2. Description of the Related Art

A scroll compressor includes a scroll compression mechanism housed in a housing, a drive shaft which drives the scroll compression mechanism, and a drive shaft support member which supports the drive shaft via a bearing. As a common technology, the drive shaft support member, being configured separately from the housing, is inserted into the housing. Radial positioning of the drive shaft support member with respect to the housing is carried out by a fit structure using a positioning pin and a pin hole, that is, a pin fit structure. The pin fit structure is formed of a positioning pin erected on a seat surface and a pin hole which is opened in the drive shaft support member so as to be fittable with the positioning pin.

Usually, two pairs of positioning pins and pin holes are used in the positioning using the pin fit structure. Each of the pin hole positions has a tolerance, and in order to prevent an interference between the positioning pins and the pin holes caused by a relative position deviation between the pin holes, generally, the positioning pins and the pin holes are assembled with a so-called clearance fit wherein an inherent clearance is provided between each pair thereof.

The drive shaft support member positioned on the housing by the pin fit structure with the clearance fit can move in a radial direction of the housing in the range of the clearance between the positioning pins and their respective pin holes. For this reason, there can occur a deviation of the axis of the drive shaft support member from that of the housing. The deviation affects the position of the bearing provided on the drive shaft support member. Then, even though the balance or form accuracy of the drive shaft is sufficiently kept, the axis of the drive shaft with respect to that of the housing deviates from an ideal position. As a result, the drive shaft itself moves eccentrically, which can be a factor leading to an occurrence of oscillations or noises of the scroll compressor.

In order to remedy the problem of the pin fit structure, it is considered that the drive shaft support member is mechanically fixed to the housing. A scroll compressor known in Patent Literature 1 is of a configuration such that a seat surface perpendicular to the axis is formed inside a housing, and that a flange of a drive shaft support member (a bearing support member) is superposed on the seat surface, and furthermore the flange and the seat surface are fixed together by bolts.

Patent Literature 1: JP-A-2009-293523

As described in Patent Literature 1, in the case of the structure in which the drive shaft support member (bearing support member) is fixed to the housing using bolts, there is a need to provide threaded holes, to which to fasten the threaded portions of the bolts, in the seat surface of the housing, and furthermore to provide insertion holes, into which to insert the bolts, in the flange. For this reason, there is a problem in that the outer diameter of the drive shaft support member increases, along with which the body diameter of the compressor increases.

SUMMARY OF THE INVENTION

The present invention, having been made to solve the above-described problem, addresses the problem of providing a technology wherein in a scroll compressor, it is possible, without affecting the body diameter of the scroll compressor, to improve the accuracy of radial positioning of a drive shaft support member with respect to a housing.

In the following description, to facilitate an understanding of the present invention, reference signs in the accompanying drawings are appended in parentheses, but the present invention is not limited thereby to the illustrative configurations.

According to the present invention, there is provided a scroll compressor (10;10A) including a housing (20); a scroll compression mechanism (60) which, being housed in the housing (20), compresses a refrigerant by a fixed scroll (70) and an orbiting scroll (80) coming into engagement with each other; a drive shaft (51) which drives the scroll compression mechanism (60); and a drive shaft support member (30;30A) which rotatably supports the drive shaft (51) via a bearing (52), wherein the drive shaft support member (30;30A) includes a plate portion (31) having a predetermined thickness in an axial direction of the drive shaft (51), one side end surface (31*a*) of the plate portion (31) in the axial direction of the drive shaft (51) has thereon a sliding support surface (31*c*) which supports the sliding movement of the orbiting scroll (80), another side end surface (31*b*) of the plate portion (31) in the axial direction of the drive shaft (51) has formed thereon a protruding portion (33;33A) which, protruding toward the other side in the axial direction, is fitted onto an inner peripheral surface (25*b*) of the housing (20), and the drive shaft support member (30;30A) is fixed to the housing (20) by the protruding portion (33;33A) being interference fitted onto the inner peripheral surface (25*b*) of the housing (20).

It is preferable that the inner peripheral surface (25*b*) of the housing (20) has a first inner peripheral surface (25*c*) onto which the protruding portion (33;33A) is interference fitted and a second inner peripheral surface (25*d*) onto which the plate portion (31) is fitted with a clearance (34) existing therebetween in a radial direction, and that a seat surface (25*e*) which supports the other side end surface (31*b*) of the plate portion (31) of the drive shaft support member (30; 30A) is provided between the first inner peripheral surface (25*c*) and the second inner peripheral surface (25*d*).

It is preferable that a distortion transfer prevention portion (35) which prevents a distortion from being transferred from the protruding portion (33;33A) to the sliding support surface (31*c*) is formed between the protruding portion (33; 33A) and the sliding support surface (31*c*).

It is preferable that the distortion transfer prevention portion (35) is an outer peripheral groove (36) formed between the protruding portion (33;33A) and the plate portion (31).

In the present invention, the one side end surface of the plate portion of the drive shaft support member has thereon the sliding support surface, and the other side end surface on the side opposite thereto has thereon the protruding portion. The protruding portion is fixed to the inner peripheral surface of the housing with an interference fit, thereby accurately positioning the drive shaft support member on the axis of the housing. The housing and the drive shaft support member can be accurately assembled concentrically by interference fitting the protruding portion.

Moreover, the sliding support surface, as it is provided on the end surface, which does not have the protruding portion, out of both end surfaces of the plate portion, is spaced axially away from the protruding portion. For this reason, a distortion of the protruding portion, which occurs by interference fitting the protruding portion onto the housing, less likely affects the flatness of the sliding support surface. Because of this, the sliding support surface can secure the performance or reliability of supporting the sliding movement of the orbiting scroll.

DESCRIPTION OF THE PREFERRED EMBODIMENTS

A description will hereinafter be given, based on the accompanying drawings, of embodiments of the present invention. The configurations shown in the accompanying drawings are examples of the present invention, and the present invention is not limited to the same configurations.

A description will be given, while referring to FIGS. 1 to 4, of a scroll compressor 10 of Embodiment 1.

Embodiment 1

Figure 1:
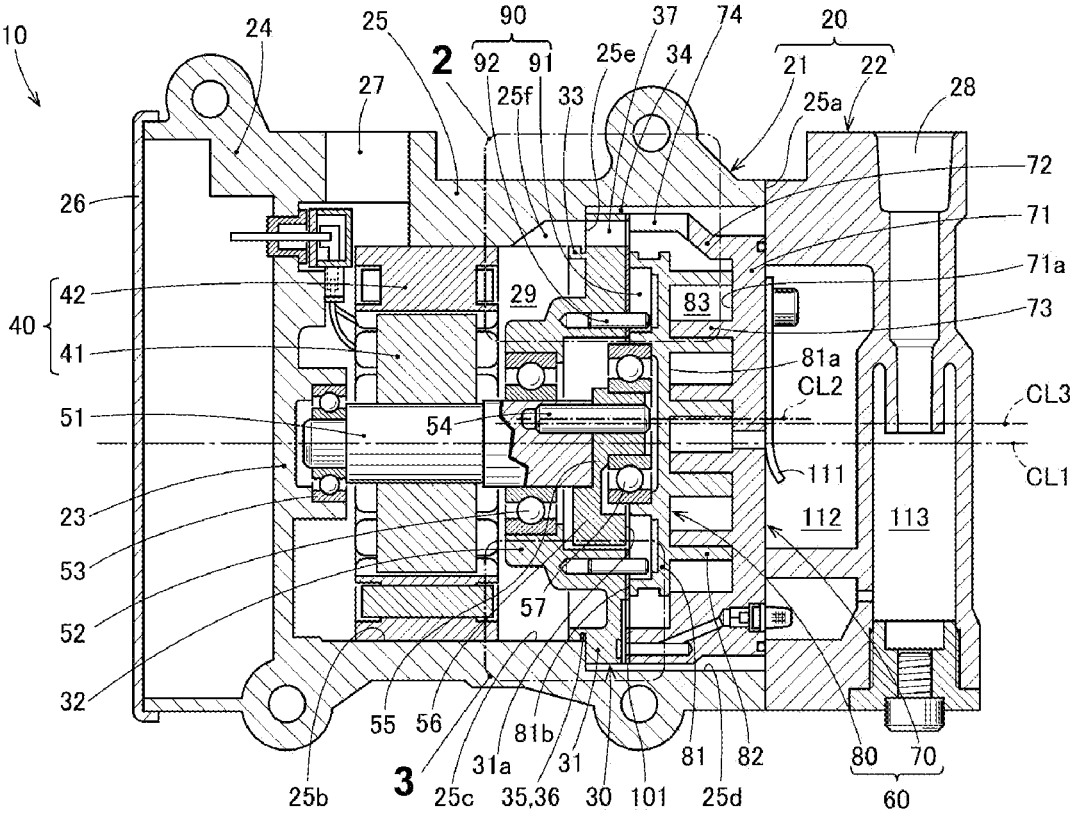
FIG. 1 is a sectional view of a scroll compressor according to Embodiment 1.

As shown in FIG. 1, the scroll compressor 10 is suitable for being used in a refrigeration cycle with a refrigerant as a working fluid, and is used in the refrigeration cycle of, for example, a vehicle air conditioner. The scroll compressor 10 is not of limited application.

The scroll compressor 10 is a so-called transverse-mounted electric compressor which has a horizontal housing 20, a drive shaft support member 30 provided inside the housing 20, an electric motor 40 housed in the housing 20, a drive shaft 51 (including an output shaft of the electric motor 40) which, extending horizontally in the housing 20, is driven by the electric motor 40, and a scroll compression mechanism 60 which is driven by the drive shaft 51.

The housing 20 has a horizontal, cylindrical first housing 21 and a second housing 22 which closes one opening of the first housing 21. The inside of the first housing 21 is longitudinally partitioned into two by an integral partition 23. One side of the first housing 21 across the partition 23 is referred to as a first cylindrical portion 24 and the other side as a second cylindrical portion 25. An opening end of the first cylindrical portion 24 is closed by a lid 26. An inverter device (not shown) which supplies drive power to the electric motor 40 is housed inside the first cylindrical portion 24. The second housing 22 is fastened to the first housing 21 by a fastening member (not shown), such as a bolt, so as to close an opening end 25*a* of the second cylindrical portion 25.

Furthermore, the housing 20 has an inlet port 27 through which to suck the refrigerant into the housing 20 from outside and an outlet port 28 through which to discharge from the housing 20 the refrigerant compressed by the scroll compression mechanism 60. The inlet port 27 is provided in the second cylindrical portion 25. The outlet port 28 is provided in the second housing 22.

The drive shaft support member 30, the electric motor 40, the drive shaft 51, and the scroll compression mechanism 60 are housed in the second cylindrical portion 25. The scroll compression mechanism 60 is positioned on the opening side in the second cylindrical portion 25. Inside the second cylindrical portion 25, a space portion 29 between the partition 23 and the scroll compression mechanism 60 is referred to hereinafter as the "low-pressure chamber 29". The drive shaft support member 30 and the electric motor 40 are positioned in the low-pressure chamber 29. The low-pressure chamber 29 communicates with the inlet port 27 via the clearance of the electric motor 40.

Inside the second cylindrical portion 25, the drive shaft support member 30 is provided between the electric motor 40 and the scroll compression mechanism 60. The drive shaft support member 30 is limited in both rotation and axial movement relative to the second cylindrical portion 25. The details of the drive shaft support member 30 will be described later.

The drive shaft 51, being positioned in the low-pressure chamber 29, as well as extending horizontally in the longitudinal direction of the second cylindrical portion 25, passes through the drive shaft support member 30 toward the scroll compression mechanism 60. The drive shaft 51 is rotatably supported by a first bearing 52 (main bearing 52) provided in the drive shaft support member 30 and a second bearing 53 (sub-bearing 53) provided in the partition 23. The result is that the drive shaft 51, as well as extending horizontally in the longitudinal direction of the housing 20, is rotatably supported on the housing 20. Each of the bearings 52, 53 is preferably configured of a rolling bearing.

Furthermore, the drive shaft 51 has an eccentric shaft 54 on one end surface thereof passing through the drive shaft support member 30. The eccentric shaft 54 (eccentric pin 54) extends toward the scroll compression mechanism 60 from the one end surface of the drive shaft 51 and is parallel to the drive shaft 51. A centerline CL2 of the eccentric shaft 54 is offset from a centerline CL1 of the drive shaft 51. The eccentric shaft 54 is rotatably fitted with an annular bush 55. A counterweight 56 (balance weight 56) protruding radially from the bush 55 is provided integrally on one portion of the bush 55. Furthermore, the outer peripheral surface of the bush 55 is fitted with the inner peripheral surface of a third bearing 57. The third bearing 57 is preferably configured of a rolling bearing. The inner peripheral surface of the bush 55 fitted over the eccentric shaft 54 is not coaxial with the outer peripheral surface of the bush 55 fitted in the third bearing 57, thereby configuring a well-known automatic aligning mechanism which allows a centerline CL3 of an orbiting scroll 80 to be positioned inside the rotation trajectory formed by the centerline CL2 of the eccentric shaft 54.

The electric motor 40 has a rotor 41 fixed to the drive shaft 51 and a stator 42 surrounding the periphery of the rotor 41. The stator 42 is fixed on an inner peripheral surface 25*b* of the second cylindrical portion 25. The drive shaft 51 functions as the output shaft of the electric motor 40.

The scroll compression mechanism 60, being one which compresses the refrigerant by a fixed scroll 70 and the orbiting scroll 80 coming into engagement with each other, is housed in the housing 20 as described above.

The fixed scroll 70 has a discoid fixed end plate 71, a cylindrical outer peripheral wall 72, and a fixed spiral body 73. The fixed end plate 71 (referred to also as the fixed plate 71), being perpendicular to the centerline CL2 of the eccentric shaft 54, is supported on the housing 20 so as to be non-rotatable relative thereto. The outer peripheral wall 72 is a cylinder which stands out circumferentially from the outer edge of one plate surface 71*a* (a surface 71*a* facing the electric motor 40) of the fixed end plate 71. The fixed spiral body 73, as well as being positioned inside the outer peripheral wall 72, stands out from the one plate surface 71*a* of the fixed end plate 71. The fixed spiral body 73 is configured in, for example, an involute curved shape. A refrigerant inlet 74 through which to suck the refrigerant inward from radially outward is formed in the outer peripheral wall 72 of the fixed scroll 70.

The orbiting scroll 80, being combined with the fixed scroll 70, revolves with respect to the fixed scroll 70. The orbiting scroll 80 has a discoid orbiting end plate 81 positioned opposite the fixed spiral body 73 and an orbiting spiral body 82.

The orbiting end plate 81, being perpendicular to the centerline CL3 of the orbiting scroll 80, is positioned inside the outer peripheral wall 72 of the fixed scroll 70. Of the orbiting end plate 81, a surface 81*a* facing the one plate surface 71*a* of the fixed end plate 71 is referred to as the "first plate surface 81*a*", and a surface 81*b* on the side opposite to the first plate surface 81*a* as the "second plate surface 81*b*".

The orbiting spiral body 82, standing out toward the fixed spiral body 73 from the first plate surface 81*a* of the orbiting end plate 81, is combined with the fixed spiral body 73, thereby forming a plurality of compression chambers 83. The orbiting spiral body 82 is configured in, for example, an involute curved shape.

The orbiting end plate 81 is rotatably supported via the third bearing 57 by the eccentric shaft 54 provided on the drive shaft 51. Consequently, the orbiting scroll 80 is driven by the drive shaft 51. The drive shaft 51 rotates, and thereby the orbiting scroll 80 can revolve (rotate eccentrically) around the centerline CL2 of the drive shaft 51.

The scroll compressor 10 has an anti-rotation mechanism 90 which prevents the rotation of the orbiting scroll 80. The anti-rotation mechanism 90 is a pin-and-ring anti-rotation mechanism which is formed of a plurality of depressed portions 91 provided in the orbiting end plate 81 and a plurality of rotation lock pins 92 provided on the drive shaft support member 30. The depressed portions 91 are referred to hereinafter as the "pin engaging depressed portions 91" and the pins 92 as the "rotation lock pins 92".

The plurality of pin engaging depressed portions 91 are perfectly circular depressions which are positioned at a regular pitch on the second plate surface 81*b* of the orbiting end plate 81 and on the concentric circle around the centerline CL3 of the orbiting end plate 81.

The plurality of rotation lock pins 92, being configured as round bars parallel to the drive shaft 51, extend into the plurality of pin engaging depressed portions 91 from the drive shaft support member 30 and are in engagement with the respective pin engaging depressed portions 91. Because of this, the orbiting scroll 80 can move with respect to the drive shaft support member 30 merely within the range of the inner peripheral surfaces of the plurality of circular pin engaging depressed portions 91.

The orbiting scroll 80 seeks to rotate along with the rotation of the drive shaft 51, but is prevented from rotating by the pin engaging depressed portions 91 and the rotation lock pins 92. Since the orbiting scroll 80 has a predetermined mass, a radial exciting force occurs along with the revolution of the orbiting scroll 80, but the radial exciting force occurring along with the revolution of the orbiting scroll 80 is balanced by the counterweight 56 provided on the bush 55 fitted over the eccentric shaft 54.

Next, a detailed description will be given of the structure of fixation of the drive shaft support member 30 to the housing 20.

Figure 2:
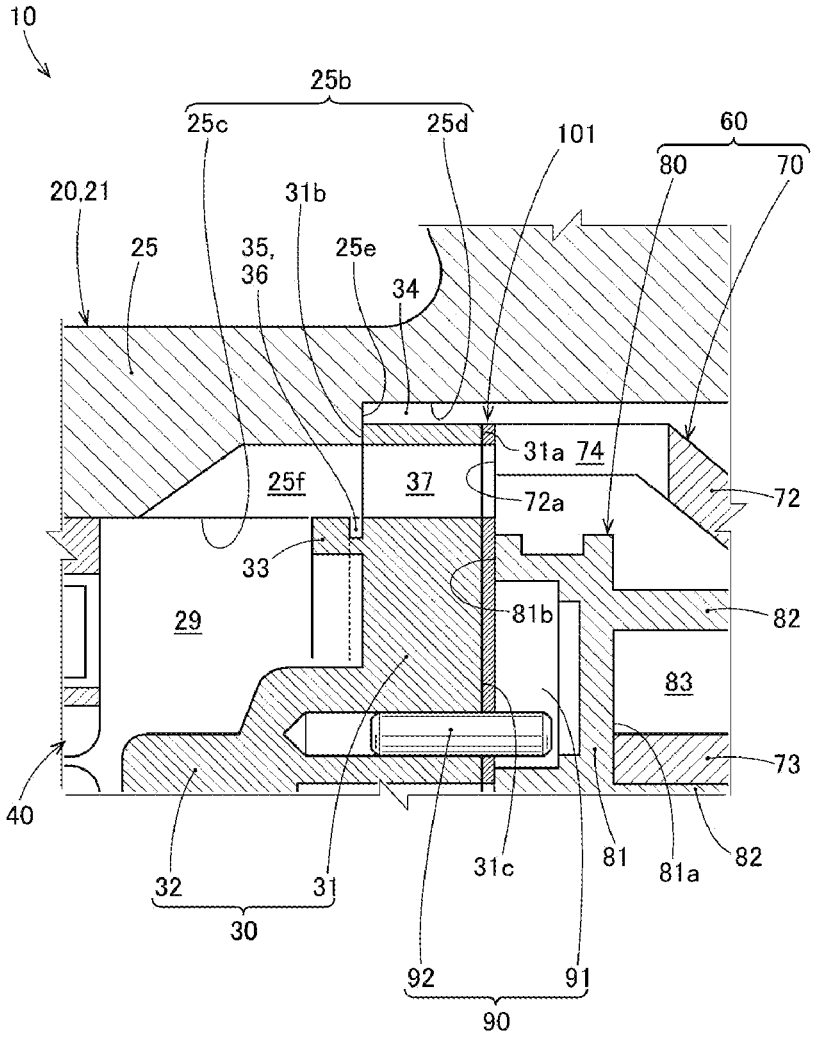
FIG. 2 is an enlarged view of the portion 2 in FIG. 1.

As shown in FIGS. 1 and 2, the inner peripheral surface 25*b* of the housing 20, that is, the inner peripheral surface 25*b* of the second cylindrical portion 25 includes a first inner peripheral surface 25*c* on the side of the electric motor 40 and a second inner peripheral surface 25*d* on the side of the scroll compression mechanism 60. The first and second inner peripheral surfaces 25*c* and 25*d* have the form of a perfect circle around the centerline CL1 of the drive shaft 51. The second inner peripheral surface 25*d* is continued to the opening end 25*a* of the second cylindrical portion 25.

Figure 3:
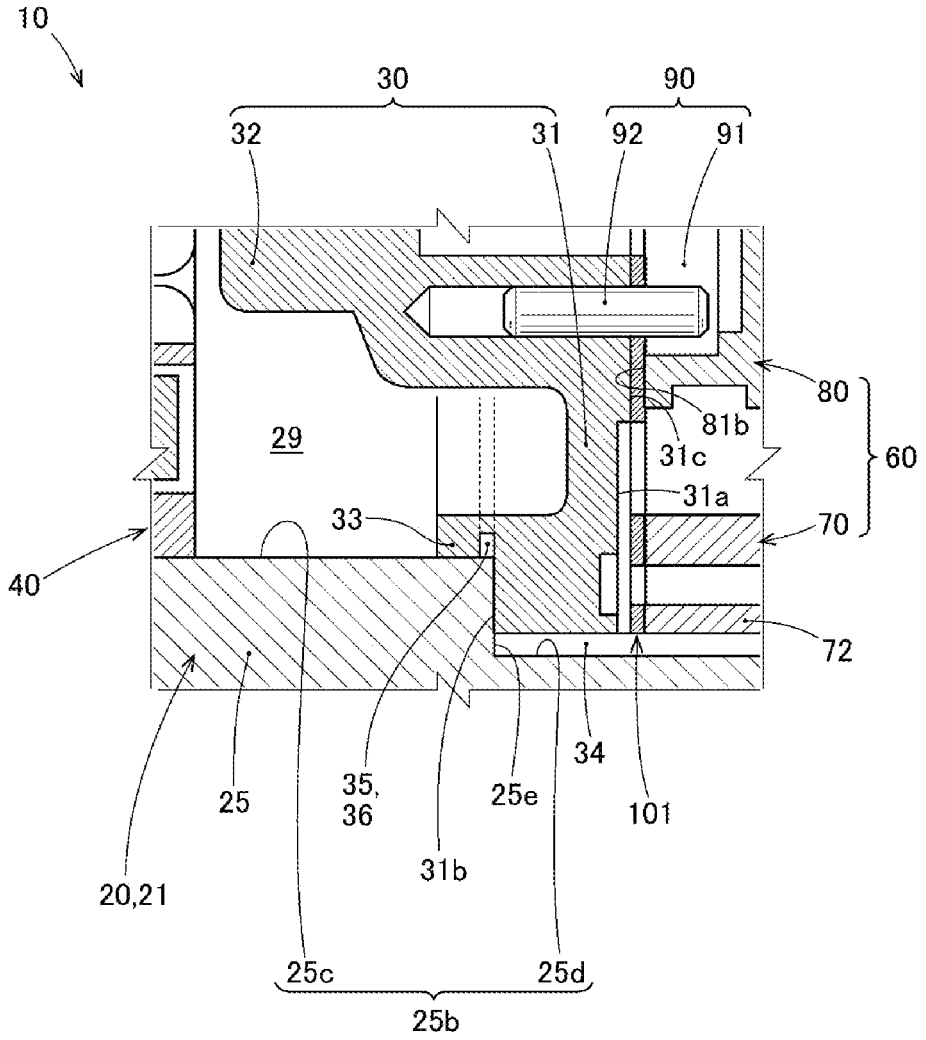
FIG. 3 is an enlarged view of the portion 3 in FIG. 1.
Figure 4:
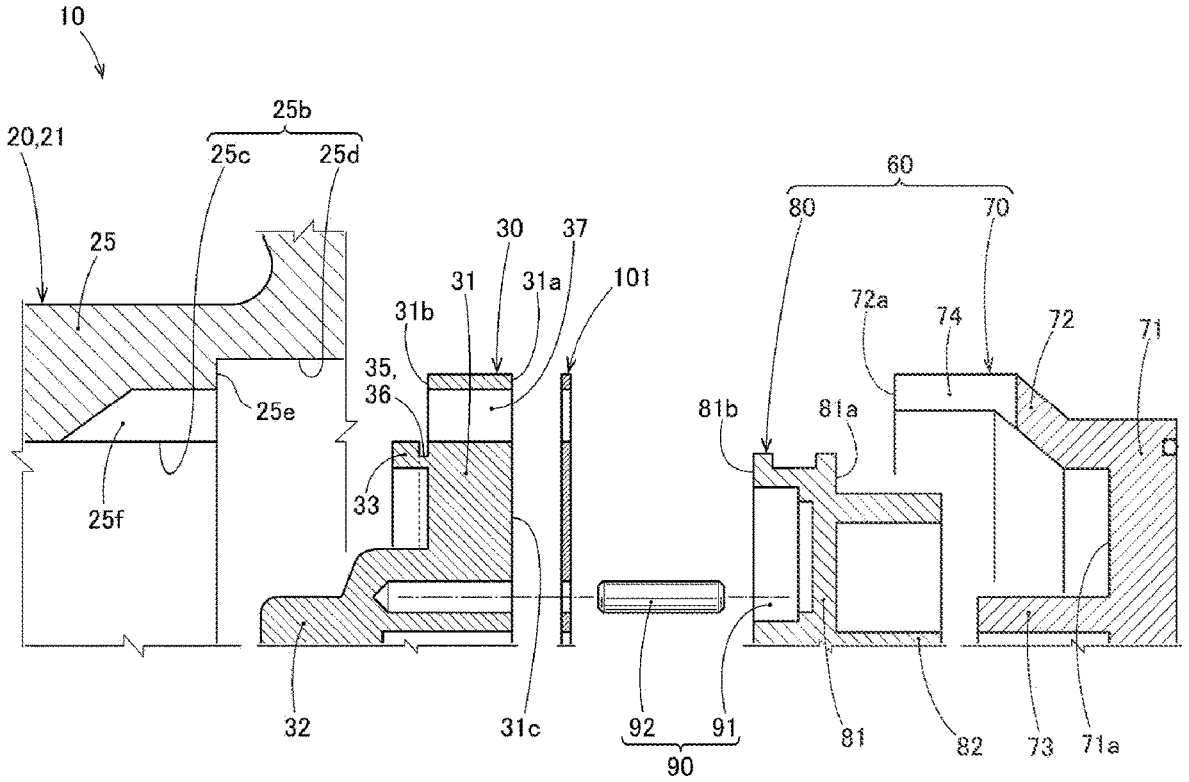
FIG. 4 is an exploded view of a housing, a scroll compression mechanism, and a drive shaft support member which are shown in FIG. 2.

As shown in FIGS. 2 to 4, the diameter of the second inner peripheral surface 25*d* is larger than that of the first inner peripheral surface 25*c*. Thus, the first and second inner peripheral surfaces 25*c* and 25*d* have a stepped surface 25*e* on the border therebetween. The stepped surface 25*e* is referred to hereinafter as the "seat surface 25*e*". The seat surface 25*e* is a plane surface perpendicular to the centerline CL1 of the drive shaft 51 shown in FIG. 1.

The drive shaft support member 30 is configured of a discoid plate portion 31, which has a preset predetermined (arbitrary) thickness in the axial direction of the drive shaft 51, and a support portion 32 integrally provided in the center of the plate portion 31. The support portion 32 is a portion which, protruding to the side of the electric motor 40 from the plate portion 31, supports the first bearing 52.

Of both end surfaces 31*a*, 31*b* of the plate portion 31 in the axial direction of the drive shaft 51, the end surface 31*a* facing the scroll compression mechanism 60 is referred to as the "one side end surface 31*a* (first end surface 31*a*)", and the end surface 31*b* facing the electric motor 40 as the "other side end surface 31*b* (second end surface 31*b*)".

The one side end surface 31*a* has a sliding support surface 31*c* which supports the sliding movement of the orbiting scroll 80. The sliding support surface 31*c*, being a plane surface perpendicular to the centerline CL1 of the drive shaft 51, is set at least in the range, of the one side end surface 31*a*, which can support the sliding movement of the orbiting scroll 80. For example, the sliding support surface 31*c* is configured as a surface flush with the one side end surface 31*a* or as a surface protruding to (refer to FIG. 3) or depressed from the side of the orbiting scroll 80 with respect to the one side end surface 31*a*. The second plate surface 81*b* of the orbiting scroll 80 is supported by the sliding support surface 31*c* so as to be sliding movable.

A thrust member 101 which can receive a thrust load caused by compression reaction force is preferably interposed between the sliding support surface 31*c* of the plate portion 31 and the second plate surface 81*b* of the orbiting scroll 80. The thrust member 101 is configured of, for example, a sheeted annular thrust race. The thrust member 101 is hereinafter rephrased as the "thrust race 101" as appropriate. The thrust race 101, being made of a material superior in abrasion resistance, can be sandwiched between the one side end surface 31*a* of the plate portion 31 and a leading end surface 72*a* of the cylindrical outer peripheral wall 72 of the fixed scroll 70. The second plate surface 81*b* of the orbiting scroll 80 is in slidable close contact with all around the thrust race 101.

A protruding portion 33 protruding toward the side of the electric motor 40 is formed on the other side end surface 31*b* of the plate portion 31. The protruding portion 33, being of an annular configuration continuing circumferentially around the centerline CL1 of the drive shaft 51, is fitted onto the inner peripheral surface 25*b* of the housing 20.

More specifically, the protruding portion 33 is fitted with an interference fit onto the inner peripheral surface 25*b* of, that is, the first inner peripheral surface 25*c* of the housing 20, and thereby the drive shaft support member 30 is fixed to the housing 20. The method of interference fit can include, for example, a press fit.

The materials of the housing 20 and of the drive shaft support member 30, the fit length and fit tolerance of the protruding portion 33 fitted onto the first inner peripheral surface 25*c*, and the thickness of the protruding portion 33 are set by taking into consideration the extent of the condition of fixation of both the protruding portion 33 and the first inner peripheral surface 25*c* with an interference fit, the accuracy of positioning, and the amount of distortion in which the protruding portion 33 seeks to undergo a radially inward falling deformation. With the protruding portion 33 completely fitted onto the first inner peripheral surface 25*c*, the other side end surface 31*b* of the plate portion 31, by coming into abutment with the seat surface 25*e*, is supported to the side of the electric motor 40.

The outer diameter of the plate portion 31 is larger than the diameter of the first inner peripheral surface 25*c* and the outer diameter of the protruding portion 33, and is smaller than the diameter of the second inner peripheral surface 25*d*. A clearance 34 is radially provided between the outer peripheral surface of the plate portion 31 and the second inner peripheral surface 25*d*. The plate portion 31 is loosely fitted to the second inner peripheral surface 25*d*.

The protruding portion 33, as it is of an annular configuration, is fitted with an interference fit onto the first inner peripheral surface 25*c*, and thereby seeks to undergo a radially inward falling deformation, which can generate a distortion. The drive shaft support member 30 having the protruding portion 33 has the function of supporting the second plate surface 81*b* (sliding surface 81*b*) of the orbiting scroll 80. For this reason, the sliding support surface 31*c* provided on the drive shaft support member 30 is required to maintain flatness. Therefore, consideration is required such that the distortion of the protruding portion 33 will not affect the flatness of the sliding support surface 31*c*.

In response to this, in Embodiment 1, the sliding support surface 31*c* and the protruding portion 33 are separately disposed on the respective end surfaces 31*a*, 31*b* of the plate portion 31, thereby spacing the sliding support surface 31*c* and the protruding portion 33 away from each other in the axial direction of the drive shaft 51.

Moreover, a distortion transfer prevention portion 35 which prevents the transfer of distortion from the protruding portion 33 to the sliding support surface 31*c* is formed between the sliding support surface 31*c* and the protruding portion 33. The distortion transfer prevention portion 35 is configured of an outer peripheral groove 36 formed between the protruding portion 33 and the plate portion 31. The outer peripheral groove 36, as well as being positioned, for example, at the base end of the protruding portion 33, is formed all around the outer peripheral surface of the protruding portion 33.

The fixation of the drive shaft support member 30 to the first housing 21 of the housing 20 is carried out after the electric motor 40 is housed in the first housing 21.

The plate portion 31 has a plurality of inlet holes 37. The inlet holes 37, as well as being intermittently positioned circumferentially and radially outside the protruding portion 33, pass through along the centerline CL1 of the drive shaft 51. The housing 20 has a plurality of inlet passages 25*f* on the first inner peripheral surface 25*c*. The inlet passages 25*f* communicate with the compression chambers 83 via the respective inlet holes 37 of the plate portion 31.

The outline of the operation of the scroll compressor 10 is as follows.

As shown in FIG. 1, the drive shaft 51 is driven by the electric motor 40, and thereby the orbiting scroll 80 revolves. As a result, the refrigerant sucked in from the inlet port 27 passes through the clearance of the electric motor 40 in the low-pressure chamber 29, passes by way of the inlet passages 25*f* of the housing 20 and the inlet holes 37 of the drive shaft support member 30, passes through the refrigerant inlet 74 of the fixed scroll 70, and enters the compression chamber 83. Along with the revolution of the orbiting scroll 80, the compression chamber 83 moves to the central side while being gradually decreased in internal volume, thereby compressing the refrigerant in the compression chamber 83. The pressure in the compression chamber 83 increases, thereby opening a check valve 111, and the compressed refrigerant flows into a discharge chamber 112 in the second housing 22, and enters an adjoining gas-liquid separation chamber 113. A gaseous refrigerant into which oil is separated by the gas-liquid separation chamber 113 is discharged outward from the outlet port 28.

What follows is a summary of the above description of the scroll compressor 10 of Embodiment 1.

As shown in FIG. 1, the scroll compressor 10 has the housing 20, the scroll compression mechanism 60 which, being housed in the housing 20, compresses the refrigerant by the fixed scroll 70 and the orbiting scroll 80 coming into engagement with each other, the drive shaft 51 which drives the scroll compression mechanism 60, and the drive shaft support member 30 which rotatably supports the drive shaft 51 via the bearing 52 (first bearing 52).

As shown in FIGS. 1 to 4, the drive shaft support member 30 includes the plate portion 31 which has a predetermined thickness in the axial direction of the drive shaft 51. The one side end surface 31*a* of the plate portion 31 in the axial direction of the drive shaft 51 has thereon the sliding support surface 31*c* which supports the sliding movement of the orbiting scroll 80. The protruding portion 33 which, protruding toward the other side in the axial direction (the side of the electric motor 40), is fitted onto the inner peripheral surface 25*b* of the housing 20 (onto the inner peripheral surface 25*b* of the second cylindrical portion 25) is formed on the other side end surface 31*b* of the plate portion 31 in the axial direction of the drive shaft 51. The drive shaft support member 30 is fixed to the housing 20 by the protruding portion 33 being interference fitted onto the inner peripheral surface 25*b* of the housing 20.

Thus, the one side end surface 31*a* of the plate portion 31 has thereon the sliding support surface 31*c*, and the other side end surface 31*b* on the side opposite thereto has thereon the protruding portion 33. The protruding portion 33 is fixed with an interference fit to the inner peripheral surface 25*b* of the housing 20, and thereby the drive shaft support member 30 is accurately positioned on the axial line CL1 of the housing 20 (on the centerline CL1 of the drive shaft 51). The housing 20 and the drive shaft support member 30 can be accurately assembled concentrically by the protruding portion 33 being interference fitted.

Moreover, the sliding support surface 31*c*, as it is formed on the end surface 31*b*, out of both end surfaces 31*a*, 31*b* of the plate portion 31, which does not have the protruding portion 33, is spaced axially away from the protruding portion 33. For this reason, the distortion of the protruding portion 33 which occurs by interference fitting the protruding portion 33 onto the housing 20 less likely affects the flatness of the sliding support surface 31*c*. Because of this, the sliding support surface 31*c* can secure the performance or reliability of supporting the sliding movement of the orbiting scroll 80.

Furthermore, the inner peripheral surface 25*b* of the housing 20 has the first inner peripheral surface 25*c* onto which the protruding portion 33 is interference fitted and the second inner peripheral surface 25*d* to which the plate portion 31 is fitted with the clearance 34 existing therebetween in the radial direction. The seat surface 25*e* which supports the other side end surface 31*b* of the plate portion 31 of the drive shaft support member 30 is provided between the first and second inner peripheral surfaces 25*c* and 25*d*.

The other side end surface 31*b* of the plate portion 31 is supported by coming into abutment with the seat surface 25*e*, thus stabilizing the posture of the plate portion 31 with respect to the housing 20. Here, the protruding portion 33 which is interference fitted onto the first inner peripheral surface 25*c* is on the side opposite to the sliding support surface 31*c* which supports the sliding movement of the orbiting scroll 80 with respect to the seat surface 25*e*. Even though distortion occurs in the protruding portion 33 due to the interference fit thereof onto the housing 20, the posture of the plate portion 31 is corrected following the seat surface 25*e*. It is possible to further curb the influence of the distortion transferred from the protruding portion 33 to the sliding support surface 31*c*.

Moreover, the diameter of the second inner peripheral surface 25*d* is set to be larger than that of the first inner peripheral surface 25*c* in order to provide the seat surface 25*e* on the inner peripheral surface 25*b* of the housing 20. The outer diameter of the plate portion 31 is increased in conformity with the diameter of the second inner peripheral surface 25*d*, and thereby it is possible to widen the sliding support surface 31*c*. This results in a higher degree of freedom in design on the relationship between the sliding support surface 31*c* and the second plate surface 81*b* of the orbiting scroll 80, and also in a higher stability in which the second plate surface 81*b* of the orbiting scroll 80 is supported by the sliding support surface 31*c*.

Furthermore, the distortion transfer prevention portion 35 which prevents the transfer of distortion from the protruding portion 33 to the sliding support surface 31*c* is formed between the protruding portion 33 and the sliding support surface 31*c*. Because of this, the distortion which occurs in the protruding portion 33 due to the interference fit thereof onto the housing 20 can be prevented by the distortion transfer prevention portion 35 from being transferred from the protruding portion 33 to the sliding support surface 31*c*.

The distortion transfer prevention portion 35 is the outer peripheral groove 36 formed between the protruding portion 33 and the plate portion 31. The outer peripheral groove 36 enables the distortion to be prevented as much as possible from transferring axially from the protruding portion 33 to the sliding support surface 31*c*.

In the above-described example, the first and second inner peripheral surfaces 25*c* and 25*d* are provided on the first housing 21, and the stepped surface 25*e* therebetween is configured as the "seat surface 25*e*", but the seat surface 25*e* is not limited to one configured by the stepped surface 25*e*. For example, a position of a parting surface (mating surface) between the first and second housings 21 and 22 is aligned with the position of the stepped surface 25*e*, and the second inner peripheral surface 25*d* is formed on the second housing 22, thereby enabling the whole of the end surface (the opening end 25*a* shown in FIG. 1) of the first housing 21 on the side of the second housing 22 to be configured as the "seat surface 25*e*". Even with this configuration, the inner peripheral surface 25*b* of the housing 20 has the first inner peripheral surface 25*c* onto which the protruding portion 33 is interference fitted and the second inner peripheral surface 25*d* to which the plate portion 31 is fitted with the clearance 34 existing therebetween in the radial direction, and the seat surface 25*e* which supports the other side end surface 31*b* of the plate portion 31 of the drive shaft support member 30 is provided between the first and second inner peripheral surfaces 25*c* and 25*d*.

Next, a description will be given, while referring to FIG. 5, of a scroll compressor 10A of Embodiment 2.

Embodiment 2

Figure 5:
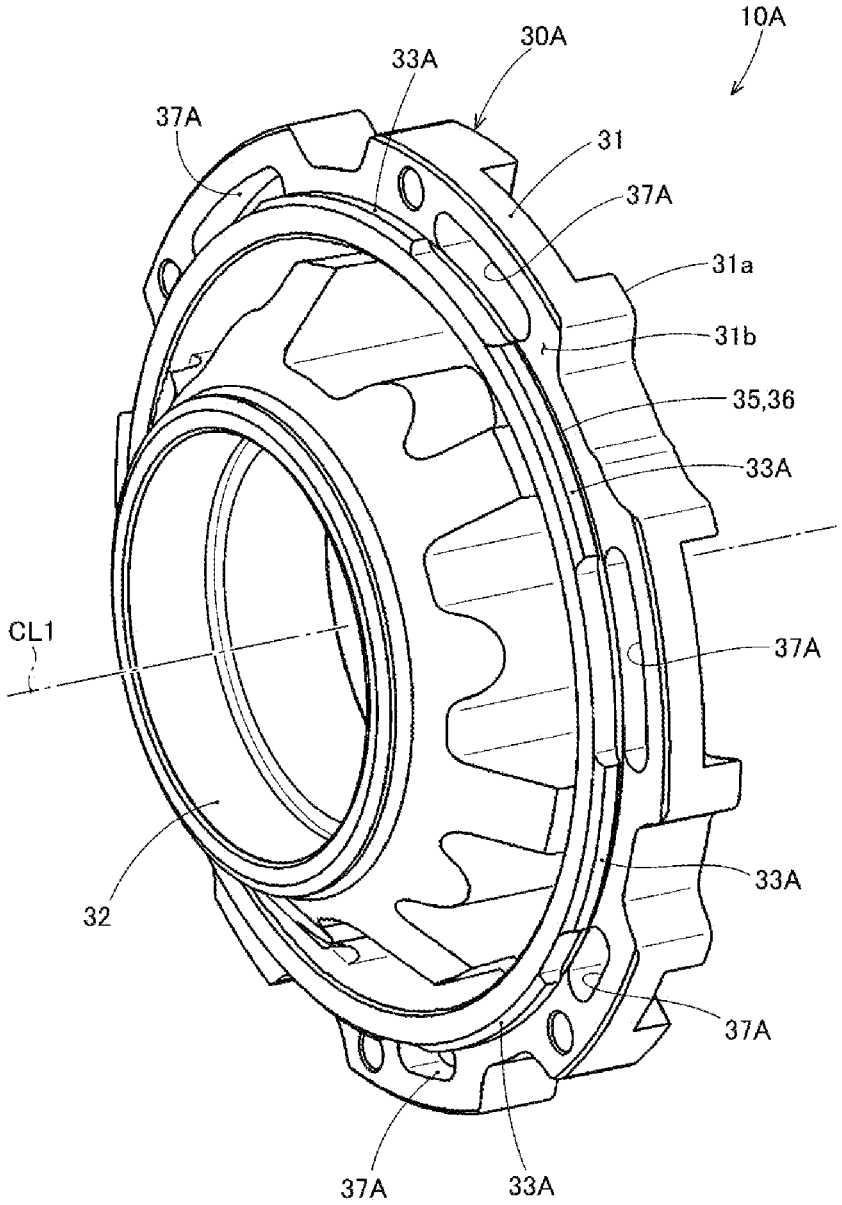
FIG. 5 is a perspective view of a drive shaft support member of a scroll compressor according to Embodiment 2.

FIG. 5 shows the configuration of a drive shaft support member 30A of the scroll compressor 10A according to Embodiment 2 seen from the side of the electric motor 40 (refer to FIG. 1).

The scroll compressor 10A of Embodiment 2 is characterized in that the drive shaft support member 30 of Embodiment 1 shown in FIGS. 1 to 4 is changed to the drive shaft support member 30A shown in FIG. 5. The other basic components are common to those of the scroll compressor 10 according to Embodiment 1. Portions common to those of the scroll compressor 10 according to Embodiment 1 will be denoted using the same signs, and the detailed description thereof will be omitted.

In the drive shaft support member 30 of Embodiment 1 shown in FIGS. 1 and 4, the plurality of inlet holes 37 are positioned radially outside the protruding portion 33. It does not happen that the inlet holes 37 are superposed on the outer peripheral surface of the protruding portion 33. Accordingly, the protruding portion 33 is of an annular configuration which continues circumferentially around the centerline CL1 of the drive shaft 51.

In contrast to this, in the drive shaft support member 30A of Embodiment 2 shown in FIG. 5, a plurality of inlet holes 37A are positioned more radially inward than the inlet holes 37 of Embodiment 1. Because of this, one portion of each of the inlet holes 37A radially overlaps the outer peripheral surface of a protruding portion 33A. In order to avoid this, the protruding portion 33A of Embodiment 2 is configured to have the portions thereof overlapping the inlet holes 37A notched away.

In detail, the protruding portions 33A of Embodiment 2 are of a configuration in which they are positioned intermittently in a circumferential direction around the centerline CL1 of the drive shaft 51 (refer to FIG. 1). That is, the plurality of independent protruding portions 33A are arc-like members which are circumferentially disposed around the centerline CL1 of the drive shaft 51. Even in this case, the outer peripheral surfaces of all the plurality of protruding portions 33A are formed so as to be concentric around the centerline CL1 and are fitted onto the inner peripheral surface 25*b* of the housing 20 shown in FIG. 4. More specifically, the plurality of protruding portions 33A are fitted with an interference fit onto the first inner peripheral surface 25*c*, and thereby the drive shaft support member 30A is fixed to the housing 20.

The scroll compressor 10A according to Embodiment 2 can exert the same advantageous effects as those of Embodiment 1.

The scroll compressor 10;10A according to the present invention, as long as it produces the operations and effects of the present invention, is not limited to the examples.

The scroll compressor 10;10A, not being limited to a transverse-mounted electric compressor, may be of a configuration in which the drive shaft 51 is driven by an external power source. It is possible to adopt, for example, a scroll compressor of a belt driven type in which engine power is transferred by a belt to a pulley provided on the drive shaft 51.

The distortion transfer prevention portion 35, not being limited to the configuration of the outer peripheral groove 36, only has to be of a configuration which prevents the transfer of distortion from the protruding portion 33, 33A to the sliding support surface 31*c*. For example, the distortion transfer prevention portion 35 may be such that a void, such as a groove, a depression, or a hole, is formed in a portion radially inside the outer peripheral surface of the protruding portion 33, 33A (but not limited to the inner peripheral surface of the protruding portion 33, 33A), thereby absorbing the distortion of the protruding portion 33, 33A caused by the interference fit. Also, the distortion transfer prevention portion 35 may be configured by reducing the radial thickness of the protruding portion 33, 33A to the degree of distortion absorbability.

The scroll compressor 10;10A of the present invention is suitable for use in the refrigeration cycle of a vehicle air conditioner.

DESCRIPTION OF REFERENCE NUMERALS AND SIGNS

10, 10A: scroll compressor
20: housing
25*b*: inner peripheral surface of housing
25*c*: electric motor side first inner peripheral surface
25*d*: scroll compression mechanism side second inner peripheral surface
25*e*: seat surface
30, 30A: drive shaft support member
31: plate portion
31*a*: one side end surface
31*b*: other side end surface
31*c*: sliding support surface
33, 33A: protruding portion
34: clearance between second inner peripheral surface and plate portion
35: distortion transfer prevention portion
36: outer peripheral groove
40: electric motor
51: drive shaft
52: bearing (first bearing)
60: scroll compression mechanism
70: fixed scroll
80: orbiting scroll

What is claimed is:

1. A scroll compressor, comprising:

a housing;

a scroll compression mechanism which, being housed in the housing, compresses a refrigerant by a fixed scroll and an orbiting scroll coming into engagement with each other;

a drive shaft which drives the scroll compression mechanism; and a drive shaft support member which rotatably supports the drive shaft via a bearing, wherein the drive shaft support member includes a plate portion having a predetermined thickness in an axial direction of the drive shaft, one side end surface of the plate portion in the axial direction of the drive shaft has thereon a sliding support surface which supports the sliding movement of the orbiting scroll, another side end surface of the plate portion in the axial direction of the drive shaft has formed thereon a protruding portion which, protruding toward the other side in the axial direction, is interference fitted onto an inner peripheral surface of the housing, the drive shaft support member is fixed to the housing by the protruding portion being interference fitted onto the inner peripheral surface of the housing, a distortion transfer prevention portion which prevents a distortion from being transferred from the protruding portion to the sliding support surface is formed between the protruding portion and the sliding support surface, and the distortion transfer prevention portion is an outer peripheral groove formed between the protruding portion and the plate portion.

2. The scroll compressor according to claim 1, wherein the inner peripheral surface of the housing has a first inner peripheral surface onto which the protruding portion is interference fitted and a second inner peripheral surface onto which the plate portion is fitted with a clearance existing therebetween in a radial direction, and a seat surface which supports the other side end surface of the plate portion of the drive shaft support member is provided between the first inner peripheral surface and the second inner peripheral surface.

* * * * *